US008256329B2

(12) United States Patent
Ota

(10) Patent No.: US 8,256,329 B2
(45) Date of Patent: Sep. 4, 2012

(54) TOOL FOR REMOVING AND REPLACING LIGHT BULB

(75) Inventor: Kinjirou Ota, Tokyo (JP)

(73) Assignee: Ota Kosan Corporation, Sumida-ku, Tokyo (JP)

( * ) Notice: Subject to any disclaimer, the term of this patent is extended or adjusted under 35 U.S.C. 154(b) by 0 days.

(21) Appl. No.: 12/935,145

(22) PCT Filed: Mar. 13, 2009

(86) PCT No.: PCT/JP2009/055556

§ 371 (c)(1),
(2), (4) Date: Sep. 28, 2010

(87) PCT Pub. No.: WO2010/103671

PCT Pub. Date: Sep. 16, 2010

(65) Prior Publication Data

US 2012/0000321 A1 Jan. 5, 2012

(51) Int. Cl.
*H01K 3/32* (2006.01)

(52) U.S. Cl. ..... 81/53.11

(58) Field of Classification Search ..... 81/53.11, 81/53.12; 294/19.2, 96, 99.1, 100, 106, 209
See application file for complete search history.

(56) References Cited

U.S. PATENT DOCUMENTS

| | | | | | |
|---|---|---|---|---|---|
| 623,180 | A * | 4/1899 | Rhine | 81/53.12 |
| 1,764,278 | A * | 6/1930 | Olby | 81/53.11 |
| 1,787,670 | A * | 1/1931 | Clarkson | 81/53.11 |
| 2,526,084 | A * | 10/1950 | Penn | 81/53.11 |
| 5,317,939 | A * | 6/1994 | Marinescu | 81/53.11 |
| 5,692,417 | A * | 12/1997 | Irpino | 81/53.12 |
| 6,223,628 | B1 * | 5/2001 | Barron | 81/53.11 |

FOREIGN PATENT DOCUMENTS

| | | |
|---|---|---|
| JP | 2003-272568 | 9/2003 |
| JP | 2006-114334 | 4/2006 |
| JP | 2006-339082 | 12/2006 |
| JP | 2008-198549 | 8/2008 |

* cited by examiner

*Primary Examiner* — David B Thomas
(74) *Attorney, Agent, or Firm* — Shoemaker and Mattare

(57) ABSTRACT

A tool for removing and replacing a light bulb includes a long handle rod, a chuck at an upper end of the handle rod, and an operating mechanism at a lower end of the handle rod for actuating the chuck. The chuck includes an arm holder, bearing brackets, chuck arms pivotally supported by the bearing brackets, tension springs for closing the chuck arms, a seat pad for receiving and supporting a top surface of the glass sphere of the light bulb, guide bars for opening the chuck arms, and a movable bar-holder-block connected to the operation mechanism for supporting the guide bars. When the movable bar-holder-block is pulled downward by the operating mechanism, the upper end portions of the chuck arms are operatively opened away from one another.

4 Claims, 11 Drawing Sheets

TOOL FOR REMOVING AND REPLACING LIGHT BULB

FIELD OF THE INVENTION

The present invention relates to a tool for removing and replacing a light bulb that is installed at a high place such as a ceiling of a house or building and, more particularly, to a light bulb changing tool.

BACKGROUND OF THE INVENTION

The applicant has already proposed a light bulb changing tool which is constructed as follows.

The light bulb changing tool includes a long handle rod adapted to be held and lifted up to a high place by the hand of an operator, and a chuck means provided at an upper end of the handle rod for holding or chucking a glass sphere of a light bulb.

The chuck means for holding or chucking a glass sphere of a light bulb includes an arm holder of a cylindrical shape fittedly fixed to the upper end of the handle rod, three bearing brackets attached to the arm holder so as to be spaced apart from one another at regular intervals around an outer periphery of the arm holder, three chuck arms for holding or chucking the glass sphere of the light bulb, each of the three chuck arms being pivotally supported at a lower end portion thereof by corresponding one of the bearing brackets, and three tension springs provided between sides of adjacent chuck arms at a position higher than the position where the chuck arms are pivotally supported by the bearing brackets, the tension springs urging the chuck arms in such a direction that causes the upper end portions of the chuck arms to approach one another, so that the upper end portions of the chuck arms are maintained closed relative to one another by the tension springs so as to allow a space to be produced among the upper end portions of the chuck arms (Japanese Patent Application Laid-Open Publication No. 2008-198549). The chucking of the light bulb by the chuck arms can be performed by causing the upper end portions of the chuck arms to be operatively opened away from one another against the actions of the tension springs while squeezing the glass sphere of the light bulb into the space among the upper end portions of the chuck arms.

When a light bulb that has been attached to a socket installed at a high place is to be removed from the socket by the light bulb changing tool, the handle rod is lifted up to the high place by an operator, and the upper end portions of the chuck arms which have been in the closed state due to the actions of the tension springs are then forcedly applied against a glass sphere of the light bulb by the operator. In this condition, the handle rod is pushed up by the operator in such a manner that tips of the upper end portions of the chuck arms can be slidingly moved from a top surface of the glass sphere of the light bulb to a region of the glass sphere that is adjacent a cap of the light bulb, while being operatively opened away from one another against the actions of the tension springs, whereby the glass sphere of the light bulb is interposedly held by the chuck arms facing one another. Then, the handle rod is rotated by the operator to unscrew the cap of the light bulb, whereby the light bulb can be removed from the socket.

When a new light bulb is to be attached to the socket in lieu of the removed light bulb, first of all, the operator manually causes a cap of the new light bulb to face upward and squeezes a glass sphere of the new light bulb into the space among the upper end portions of the chuck arms in the closed state, while causing the upper end portions of the chuck arms to be operatively opened away from one another against the actions of the tension springs and causing the tips of the upper end portions of the chuck arms to be slidingly moved from a top surface of the glass sphere of the light bulb to a region of the glass sphere that is adjacent the cap of the light bulb, whereby the glass sphere of the new light bulb is chucked by the chuck arms. In this condition, the operator holds and lifts up the handle rod in such a manner that the cap of the light bulb held by the chuck arms is received in the socket installed at the high place, and then rotates the handle rod to screw the cap of the light bulb into the socket, whereby the new light bulb is attached to the socket.

Release of the chuck arms from the glass sphere of the new light bulb attached to the socket can be performed by pulling the handle rod downward to thereby cause the tips of the upper end portions of the chuck arms to be slidingly moved to the top surface of the glass sphere of the light bulb from the region of the glass sphere that is adjacent the cap of the light bulb, while causing the upper end portions of the chuck arms to be operatively opened away from one another against the actions of the tension springs.

SUMMARY OF THE INVENTION

In accordance with the present invention, there is provided a light bulb changing tool that includes a long handle rod adapted to be held and lifted up to a high place by the hand of an operator, a chuck means provided at an upper end portion of the handle rod for chucking or holding a glass sphere of a light bulb, and an operating means provided at a lower end portion of the handle rod for actuating the chuck means.

The chuck means includes an arm holder of a substantially cylindrical shape fixed to the upper end portion of the handle rod, the arm holder having a movable bar-block and a first extension spring for urging the movable bar-holder-block upward, the movable bar-holder-block and the first extension spring being housed within the arm holder; the arm holder being formed with at least three vertically extending holes which are spaced apart from one another at regular intervals around a periphery of the arm holder, at least three bearing brackets attached to the arm holder so as to be spaced apart from one another at regular intervals around an outer periphery of the arm holder, at least three chuck arms for chucking or holding the glass sphere of the light bulb, the chuck arms being pivotally supported at lower end portions thereof on the bearing brackets with upper end portions thereof extending to a position higher than the arm holder, each of the chuck arms having a length that allows a tip of the upper end portion of the chuck arm to hold a region of the glass sphere which is adjacent a cap of the light bulb, second tension springs for urging the chuck arms in such a direction that causes the upper end portions of the chuck arms to be closed relative to one another, each of the second tension springs being stretched between adjacent chuck arms, a seat pad attached to the upper end of the arm holder for receiving and supporting a top surface of the glass sphere held or chucked by the chuck arms, and at least three guide bars for causing the chuck arms to be pivoted in such a manner that the upper end portions of the chuck arms are operatively opened away from one another against actions of the second tension springs, each of the guide bars being slidably combined with corresponding one of the chuck arms and supported through corresponding one of the vertically extending holes of the arm holder by the movable bar-holder-block, and the movable bar-holder-block being connected to the operating means via a traction wire.

In the light bulb changing tool according to the present invention, the guide bars are slidably combined with the chuck arms and supported by the movable bar-holder-block that is connected to the operating means via the traction wire, so that when the operating means is operated by the operator, the bar holder block is moved downward within the arm holder against the action of the first extension spring while allowing the guide bars to be moved downward relative to the chuck arms, to thereby cause the chuck arms to be pivoted against the actions of the second tension springs in such a manner that the upper end portions of the chuck arms are operatively opened away from one another. Thus, the upper end portions of the chuck arms are maintained in a closed state.

In this condition, when a light bulb that has been attached to a socket installed at a high place, such as a ceiling of a house or building, is to be removed from the socket by the light bulb changing tool, the handle rod is lifted up to the high place by the operator and the glass sphere of the light bulb can be positively received in a space among the opened upper end portions of the chuck arms and supported on the seat pad. After the glass sphere of the light bulb is received in the space among the upper end portions of the chuck arms and supported on the seat pad, the operation means is released from the operation by the operator. At this time, the bar holder block is moved upward within the arm holder by the action of the first extension spring, and the guide bars are synchronously moved upward, whereby the upper end portions of the chuck arms are operatively closed relative to one another due to the actions of the second tension springs. Thus, the glass sphere of the light bulb can be positively held or chucked by the chuck arms. In this condition, the light bulb can be removed from the socket by rotating the handle rod to unscrew the cap of the light bulb. Then, the operator again operates the operating means in such a manner that the upper end portions of the chuck arms are operatively opened away from one another as discussed above, and can manually remove the light bulb from the chuck arms.

After the light bulb is removed from the chuck arms, the operator places a new light bulb into the space among the opened upper end portions of the chuck arms in such a manner that a top surface of a glass sphere of the new light bulb is carried on the seat pad. In this condition, when the operator releases the operation of the operating means, the upper end portions of the chuck arms are operatively closed relative to one another due to the actions of the second tension springs, to thereby chuck the new light bulb. Thus, the operator can attach the new light bulb to the socket in lieu of the removed light bulb by lifting the handle rod up to the high place and rotating it to screw the cap of the new light bulb into the socket.

Therefore, according to the light bulb changing tool of the present invention, it is possible to reliably hold the glass sphere of the light bulb at the high place with the chuck means, easily remove the light bulb from the socket at the high place by rotating the handle rod to unscrew the cap of the light bulb, and easily attach the new light bulb to the socket in lieu of the removed light bulb by rotating the handle to screw the cap of the new light bulb into the socket.

In a preferred embodiment of the present invention, the light bulb comprises a large-sized light bulb having a large-sized glass sphere, a medium-sized light bulb having a medium-sized glass sphere, or a small-sized light bulb having a small-sized glass sphere. A length of each of the chuck arms is increased in order that the tip of the upper end portion of the chuck arm can hold a region of the large-sized glass sphere which is adjacent a cap of the large-sized light bulb. The seat pad is attached to the upper end portion of the arm holder through a tubular strut which is received in the arm holder and supported so as to be urged upward by a third extension spring that is provided between the tubular strut and the arm holder.

In this case, when the glass sphere of the small-sized light bulb is held by the chuck arms, the glass sphere of the small-sized light bulb is received in the opened upper end portions of the chuck arms, and a top surface of the glass sphere is received and supported on the seat pad. A region of the small light bulb which is adjacent a cap of the light bulb is held by the tips of the upper end portions of the chuck arms.

Moreover, when the glass sphere of the large-sized light bulb is held by the chuck arms, the glass sphere of the large-sized light bulb is received in the opened upper end portions of the chuck arms. In this condition, when the seat pad is pressed against a top surface of the glass sphere of the light bulb by pushing the handle rod up, the tubular strut is moved into the arm holder against the action of the third extension spring, and the top surface of the glass sphere is elastically supported by the seat pad. Then, when the operation of the operating means by the operator is released, the upper end portions of the chuck arms are operatively closed relative to one another due to the actions of the second tension springs, whereby a region of the glass sphere that is adjacent a cap of the light bulb can be positively held or chucked by the tips of the upper end portions of the chuck arms.

Thus, the tool according to the embodiment of the present invention can easily remove and replace any light bulbs having glass spheres of different sizes, such as the small-sized light bulb, the medium-sized light bulb, and the large-sized light bulb.

In a preferred embodiment of the present invention, each of the guide bars includes a first axial portion obliquely extending vertically, a second axial portion extending laterally from a lower end of the first axial portion, and a third linear axial portion extending upward from an upper end of the first axial portion, and each of the chuck arms has a vertically extending slit formed in the lower end portion thereof, the guide bar being slidably combined with the chuck arm with the second axial portion thereof being projected out of the chuck arm through the vertically extending slit and with the remaining axial portions being arranged inside the chuck arm and supported by corresponding one of the bearing brackets. A tip end portion of the second axial portion is fixed to the bar holder block through the corresponding one of the vertically extending holes of the arm holder.

In this case, the remaining axial portions of the guide arm are supported by the bearing bracket, so that the upper end portions of the chuck arms can be stably opened away from one another and stably closed relative to one another by the movement of the guide bars.

DETAILED DESCRIPTION OF A PREFERRED EMBODIMENT

A light bulb changing tool according to a preferred embodiment of the present invention is used to remove a light bulb attached to a socket that is installed at a high place, such as a ceiling of a house or building, and then attach a new light bulb to the socket in lieu of the removed light bulb. In particular, the light bulb changing tool is configured so as to be capable of attaching and detaching light bulbs having glass spheres of different sizes. A light bulb having a large-sized glass sphere, a light bulb having a medium-sized glass sphere, and a light bulb having a small-sized glass sphere are hereinafter referred to as "a large-sized light bulb", "a medium-sized light bulb", and "a small-sized light bulb", respectively.

Figure 1:
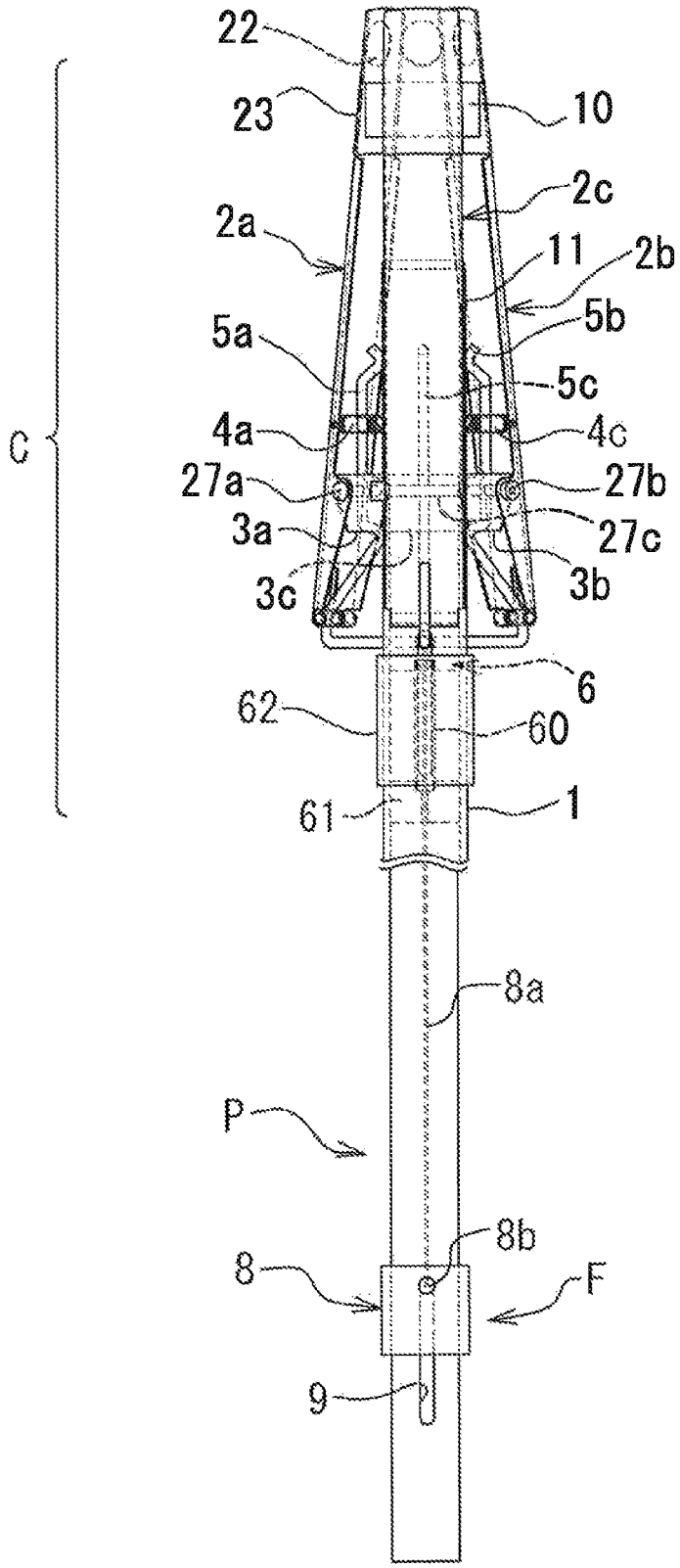
FIG. 1 is a schematic front view illustrating a light bulb changing tool according to an embodiment of the present invention, in which a substantially intermediate portion of a handle rod of the light bulb changing tool is omitted.

Referring to FIG. 1, the light bulb changing tool includes a long handle rod P adapted to be held and lifted up to the high place by the hand of an operator, a chuck means C provided at an upper end portion of the handle rod P for chucking or holding a glass sphere of a light bulb, and an operating means F provided at a lower end portion of the handle rod P for actuating the chuck means C.

The handle rod P is made of a round pipe which is made of, for example, stainless steel.

Figure 2:
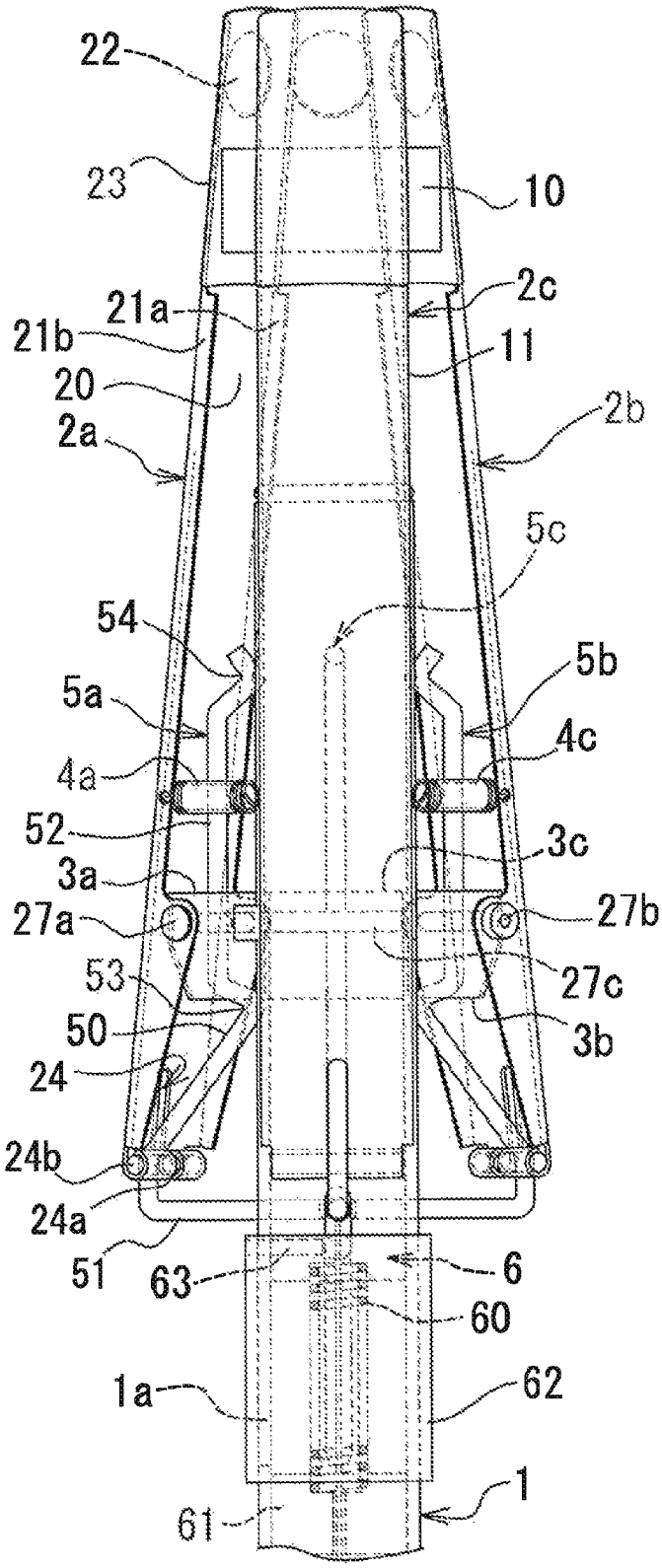
FIG. 2 is a schematic front view illustrating a chuck means with which the light bulb changing tool shown in FIG. 1 is provided.

Referring to FIG. 2, the chuck means C includes an arm holder 1 of a substantially cylindrical shape made of an insulating resin and mounted around the upper end portion of the handle rod P, and at least three longitudinal chuck arms 2*a*, 2*b*, 2*c* provided around an outer periphery of the arm holder 1 so as to be spaced apart from one another at regular intervals around the outer periphery of the arm holder 1.

The chuck arms 2*a*, 2*b*, 2*c* are formed by bending thin metal plates made of, for example, stainless steel and have the same shape and structure. The chuck arms 2*a*, 2*b*, 2*c* are attached, through bearing brackets 3*a*, 3*b*, 3*c* that will be discussed in greater detail hereinafter, to the arm holder 1 in the same manner.

Figure 3A:
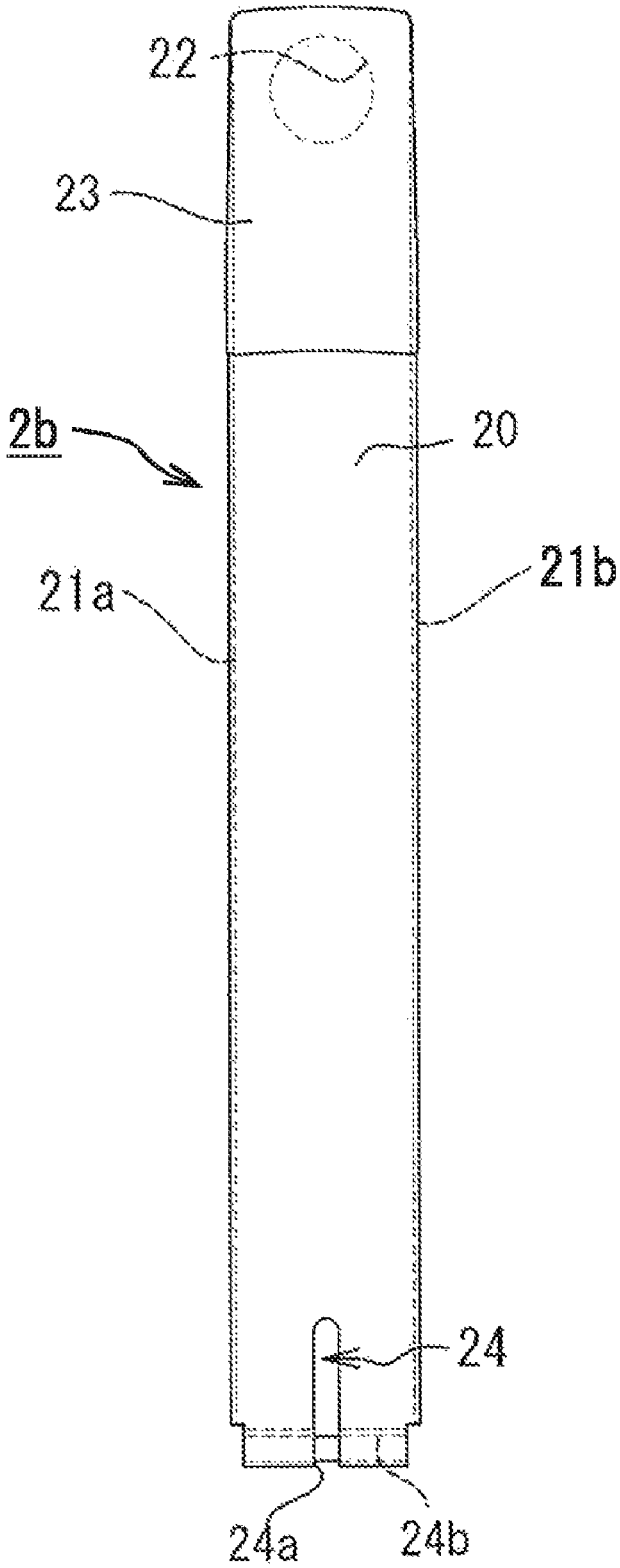
FIG. 3*a* is a schematic front view illustrating a chuck arm of the chuck means shown in FIG. 2.
Figure 3B:
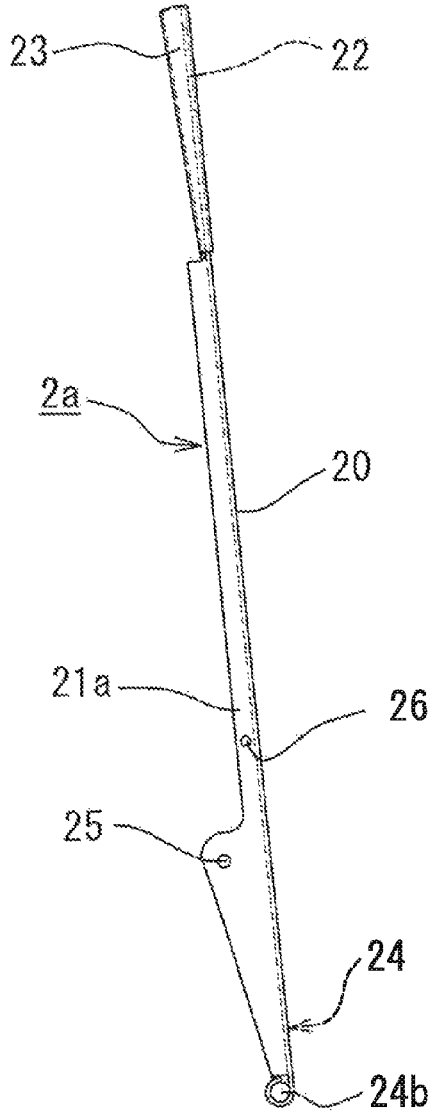
FIG. 3*b* is a schematic side view illustrating the chuck arm shown in FIG. 3*a;*

Referring to FIGS. 3*a* and 3*b*, each of the chuck arms 2*a*, 2*b*, 2*c* (only one 2*a* of the chuck arms is shown in FIGS. 3*a* and 3*b*) includes a belt-shaped main section 20, and a pair of opposing flange portions 21*a*, 21*b* provided at both edges of the main section 20 and bent at a right angle from the both edges of the main section 20. An upper end portion of the main section 20 of the chuck arm is slightly curved in a width direction thereof so as to have a curved surface that matches a spherical surface of the glass sphere. Moreover, a tip of the upper end portion of the main section 20 is slightly curved inward in a claw shape. The upper end portion of the main section 20 is formed with a through-hole 22 of a substantially circular-shape that facilitates reducing of an area of the upper end portion of the main section 20 which comes into contact with the glass sphere of the light bulb. Moreover, the entire upper end portion of the main section 20 is covered by a cover 23 for providing buffering function to absorb shock that is applied to the glass sphere of the light bulb attached to the socket at the high place, when the chuck arm is applied against the glass sphere of the light bulb, and for providing the chuck arm with slipping prevention function. The cover 23 is made of an elastic material such as rubber. The flange portions 21*a*, 21*b* of the chuck arm vertically extend along the both edges of the main section 20 except for both edges of the upper end portion of the main section 20. The flange portions 21*a*, 21*b* has lower end portions which are bulged and narrowed in a downward direction. A lower end portion of the main section 20 is formed with a vertically extending slit 24 through which a guide bar which will be discussed in greater detail hereinafter is slidably inserted. The slit 24 comprises a cutout hole 24*a* that is formed so as to extend upward from a lower edge of the main section 20 and located at a center of the main section 20 in the width direction. The lower edge of the main section 20 which is divided into two regions by the cutout hole 24*a* is formed in a circular shape in cross-section. An engaging pin 24*b* is retained in the circular-shaped lower edge of the main section 20.

Moreover, the flange portions 21*a*, 21*b* of the chuck arm are formed with bearing holes 25 through which a support pin for supporting the chuck arm is inserted, and retaining holes 26 into which tension springs that will be discussed in greater detail hereinafter are hooked. Bearing brackets 3*a*, 3*b*, 3*c* whose number corresponds to that of the chuck arms 2*a*, 2*b*, 2*c* are attached to the arm holder 1 so as to be spaced apart from one another at regular intervals around the outer periphery of the arm holder 1 (see FIG. 2).

Figure 4:
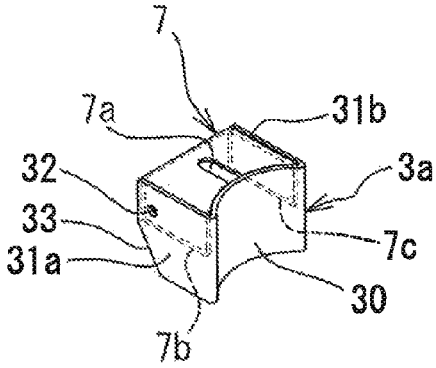
FIG. 4 is a schematic perspective view illustrating a bearing bracket of the chuck means shown in FIG. 2.

Referring to FIG. 4, each of the bearing brackets 3*a*, 3*b*, 3*c* (only one 3*a* of the bearing brackets is shown in FIG. 4) has a body which is formed in a substantially U-shape in cross-section by bending a thin metal plate made of, for example, stainless steel. The bearing bracket body includes a circular arc-shaped applying plate portion 30 that is applied and attached onto the outer surface of the arm holder 1 by, for example, rivets, and a pair of opposing side plate portions 31*a*, 31*b* that are provided at both side edges of the applying plate portion 30 and bent at a right angle from the both side edges of the applying plate portion 30. The opposing side plate portions 31*a*, 31*b* are formed with bearing holes 32 (only one of the bearing holes 32 is shown in FIG. 4) through which the support pin for supporting the chuck arm is inserted.

As will be discussed hereinafter, the chuck arms are pivotally supported on the bearing brackets. One side edge of each of the side plate portions 31*a*, 31*b* of each of the bearing brackets has an obliquely notched region 33 which facilitates prevention of interference between the bearing bracket and the corresponding chuck arm. Thus, the chuck arms can be smoothly pivoted without being interfered with the bearing brackets.

Each of the bearing brackets 3*a*, 3*b*, 3*c* further has a piece 7 of a substantially U-shape in cross-section fixedly combined with the bearing bracket body. The substantially U-shaped piece 7 is formed by bending a thin metal plate made of, for example, stainless steel and includes a pair of spaced apart side plate portions 7*b*, 7*c*, and a top plate portion interconnecting the side plate portions 7*b*, 7*c*. More particularly, the substantially U-shaped piece 7 is fixedly combined with the bearing bracket body, with the side plate portions 7*b*, 7*c* thereof being engaged with the side plate portions 31*a*, 31*b* of the bearing bracket body. The top plate portion of the substantially U-shaped piece 7 is formed with a through-hole 7*a*.

As shown in FIG. 2, the chuck arm 2*a*, the chuck arm 2*b*, and the chuck arm 2*c* are pivotally supported on the bearing bracket 3*a*, the bearing bracket 3*b*, and the bearing bracket 3*c*, respectively. More particularly, the bearing bracket 3*a*, the bearing bracket 3*b*, and the bearing bracket 3*c* are received in a space between the lower end portions of the opposing flange portions of the chuck arm 2*a*, a space between the lower end portions of the opposing flange portions of the chuck arm 2*b*, and a space between the lower end portions of the opposing flange portions of the chuck arm 2*c*, respectively. A support pin 27*a* is inserted through the flange portions of the chuck arm 2*a*, the side plate portions of the bearing bracket 3*a*, and the side plate portions of the substantially U-shaped piece combined with the bearing bracket 3*a*, whereby the chuck arm 2*a* is pivotally supported on the bearing bracket 3*a* via the support pin 27*a* with the upper end portion thereof extending to a position higher than the arm holder 1. Similarly, a support pin 27*b* is inserted through the flange portions of the chuck arm 2*b*, the side plate portions of the bearing bracket 3*b*, and the side plate portions of the substantially U-shaped piece combined with the bearing bracket 3*b*, whereby the chuck arms 2*b* is pivotally supported on the bearing bracket 3*b* via the support pin 27*b* with the upper end portion thereof extending to the position higher than the arm holder 1. Similarly, a support pin 27*c* is inserted through the flange portions of the chuck arm 2*c*, the side plate portions of the bearing bracket 3*c*, and the side plate portions of the substantially U-shaped piece combined with the bearing bracket 3*c*, whereby the chuck arm 2*c* is pivotally supported on the bearing bracket 3*c* via the support pin 27*c* with the upper end portion thereof extending to the position higher than the arm holder 1.

Figure 5:
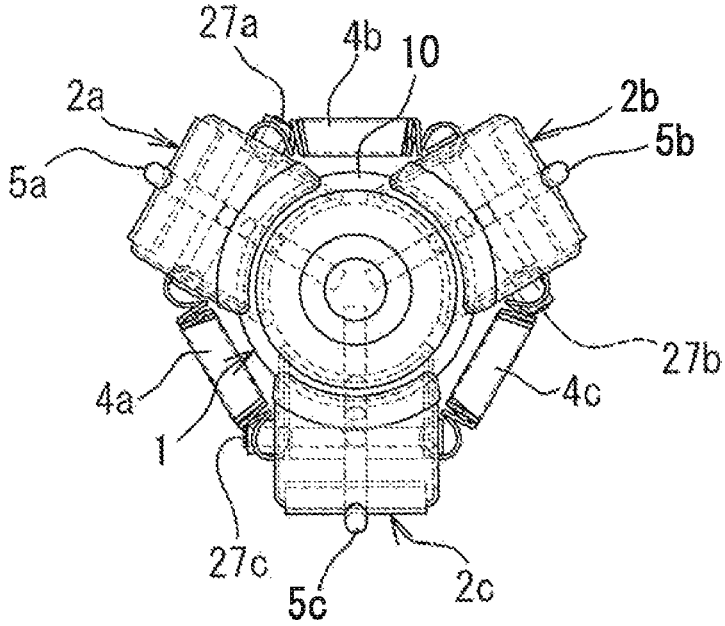
FIG. 5 is a schematic plan view illustrating the chuck means shown in FIG. 2.

Referring to FIGS. 2 and 5, at a position near and higher than the position where the chuck arms 2*a*, 2*b*, 2*c* are pivotally supported on the bearing brackets 3*a*, 3*b*, 3*c* by the support pins 27*a*, 27*b*, 27*c*, a tension spring 4*a*, a tension spring 4*b*, and a tension spring 4*c* are stretched between adjacent flange portions of the chuck arms 2*a*, 2*c*, between adjacent flange portions of the chuck arms 2*a*, 2*b*, and between adjacent flange portions of the chuck arms 2*b*, 2*c*, respectively, whereby the upper end portions of the chuck arms 2*a*, 2*b*, 2*c* are biased by the tension springs 4*a*, 4*b*, 4*c* in such a direction as to be closed relative to one another.

Figure 6:
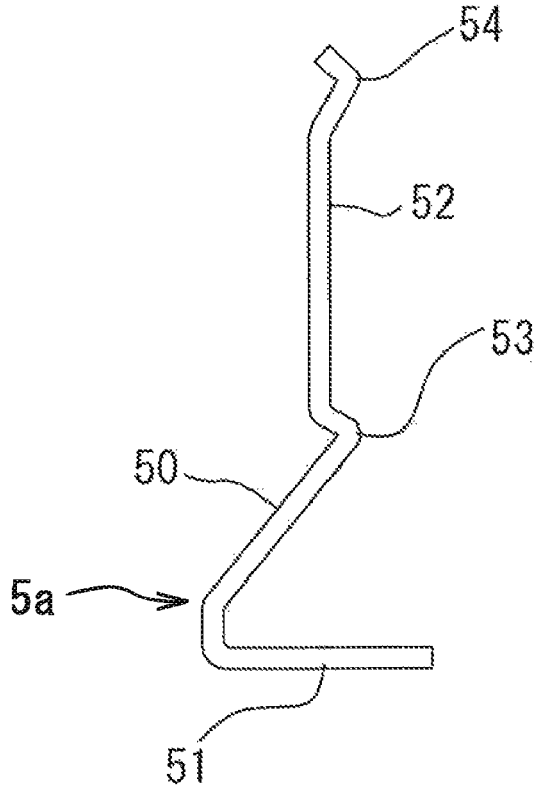
FIG. 6 is a schematic side view illustrating a guide bar of the chuck means shown in FIG. 2.

As shown in FIG. 2, the chuck means further includes guide bars 5*a*, 5*b*, 5*c* whose number corresponds to that of the chuck arms. Each of the guide bars 5*a*, 5*b*, 5*c* is formed by bending a metal wire rod. Referring now to FIG. 6, each of the guide bars 5*a*, 5*b*, 5*c* (only one 5*a* of the guide bars is shown in FIG. 6) includes a first axial portion 50 obliquely extending vertically, a second axial portion 51 extending laterally from a lower end of the first axial portion 50 and bent in a substantially L-shape, a third linear axial portion 52 extending upward from an upper end of the first axial portion 50, a fourth axial portion 53 continuously connected between the first axial portion 50 and the third axial portion 52 and bent in a substantially V-shape, and a fifth axial portion 54 extending upward from an upper end of the third axial portion 52 and bent in a substantially V-shape. The fourth and fifth axial portions 53, 54 act as support points of the guide bar.

Figure 7:
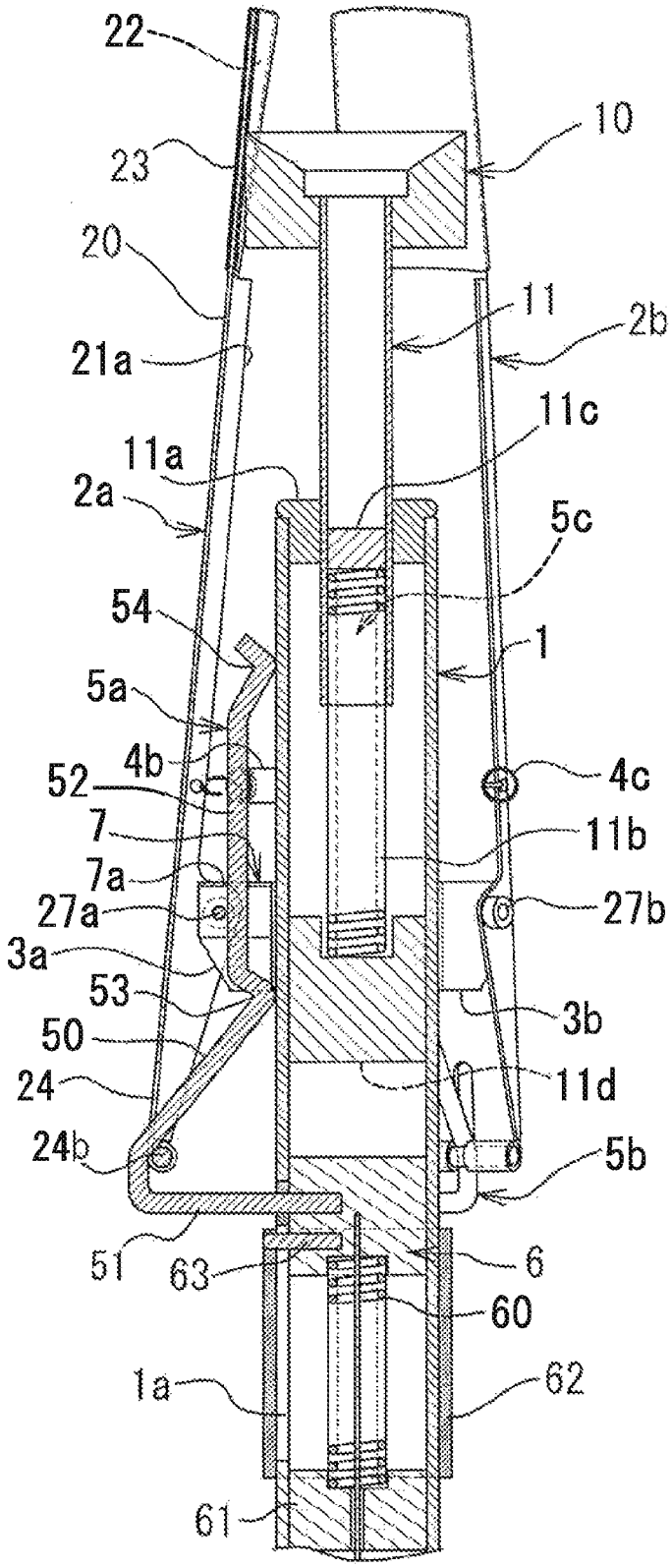
FIG. 7 is a schematic sectional view illustrating an internal structure of the chuck means shown in FIG. 2.

Referring to FIG. 7, each of the guide bars 5*a*, 5*b*, 5*c* (the details of the only guide bar 5*a* are shown in FIG. 7) is supported by a bar holder block 6 that is housed within the arm holder 1 so as to be vertically movable. More particularly, each of the guide bars 5*a*, 5*b*, 5*c* is slidably combined with corresponding one of the chuck arms 2*a*, 2*b*, 2*c*, with the second axial portion 51 thereof being projected outward from the chuck arm via the vertically extending slit 24 of the chuck arm, and with the remaining axial portions thereof being arranged inside the chuck arm. A tip end region of the second axial portion 51 is inserted through corresponding one of three vertically extending holes 1*a* formed in the arm holder 1 so as to be spaced apart from one another at regular intervals around the periphery of the arm holder 1 (only one of the vertically extending holes 1*a* is shown in FIG. 7). Moreover, the tip end region of the second axial portion 51 is fixedly embedded in the bar holder block 6 that is vertically movably housed within the arm holder 1 as discussed above. The lower end of the first axial portion 50 of each of the guide bars 5*a*, 5*b*, 5*c* is engaged with the lower edge of the vertically extending slit 24 of the chuck arm. Thus, when the bar holder block 6 housed within the arm holder 1 is moved downwardly by the operating means F as will be discussed in greater detail hereinafter, the guide bars 5*a*, 5*b*, 5*c* are moved downward relative to the chuck arms 2*a*, 2*b*, 2*c* and the arm holder 1.

The third linear axial portion 52 of the guide bar is slidably inserted through the through-hole 7*a* of the substantially U-shaped piece 7 fixedly combined with the bearing bracket as discussed above, and extends upward. Moreover, the substantially V-shaped axial portions 53, 54 of the guide bar are abutted against the outer surface of the arm holder 1 so as to be vertically slidable relative to the outer surface of the arm holder 1.

The arm holder 1 has a spring-receiving block 61 that is housed within the arm holder 1 and fixedly arranged below the bar holder block 6 so as to be vertically spaced apart from the bar holder block 6. The arm holder 1 further has a first extension spring 60 that is a coil spring and housed within the arm holder 1 and provided between the bar holder block 6 and the spring-receiving block 61, so that the bar holder block 6 is supported and biased upward by the first extension spring 60. A cover ring 62 is movably mounted around the arm holder 1 and has at least one support pin 63 provided thereat so as to horizontally project into the cover ring 62. The support pin 63 is inserted through any one of the vertically extending holes 1*a* of the arm holder 1 and fixedly embedded at a tip end portion thereof in the bar holder block 6, so that the cover ring 62 is integrally fixed to the bar holder block 6 by the support pin 63 so as to be vertically movable together with the bar holder block 6 while being guided by the vertically extending hole 1*a* of the arm holder 1. Moreover, the cover ring 62 is mounted on the arm holder 1 so as to cover the vertically extending holes 1*a* of the arm holder 1. Incidentally, the cover ring 62 may have two or three support pins 63, each of which is inserted through any one of the three vertically extending holes 1*a* of the arm holder 1 and fixedly embedded at a tip end portion thereof in the bar holder block 6.

The bar holder block 6 is connected to the operating means F via a traction wire 8*a* (FIG. 1) which is arranged within the handle rod P. As shown in FIG. 1, the operating means F includes a movable ring 8 slidably mounted around the lower end portion of the handle rod P. The handle rod P has a vertically extending hole 9 formed in the lower end portion thereof. The movable ring 8 has a guide pin 8*b* inserted through the vertically extending hole 9 of the handle rod P and is adapted to be vertically slid along the handle rod P while being guided by the vertically extending hole 9 of the handle rod P. The traction wire 8*a* is passed through the spring-receiving block 61 and the first extension spring 60, retained at an upper end thereof to the bar holder block 6, and retained at a lower end thereof to the guide pin 8*b* of the movable ring 8.

Figure 8A:
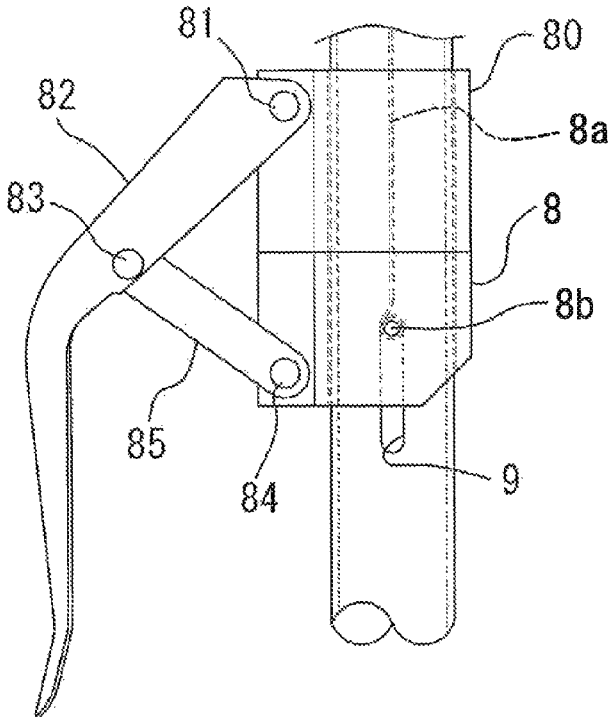
FIG. 8*a* is a schematic front view illustrating an operating means for actuating the chuck means provided at the tool shown in FIG. 1.
Figure 8B:
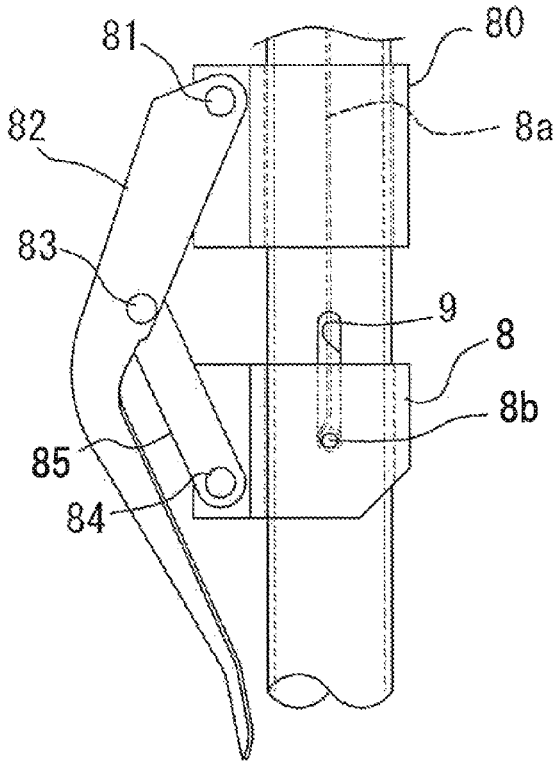
FIG. 8*b* is a schematic front view for explaining the operation of the operating means shown in FIG. 8*a;*

Referring to FIGS. 8*a* and 8*b*, the operating means F further includes a stationary ring 80 and an operating lever 82. The stationary ring 80 is fixedly mounted around the lower end portion of the handle rod P and arranged above the movable ring 8. The operating lever 82 is pivotally supported at an upper end thereof on the stationary ring 80 by a support pin 81, and connected to the movable ring 8 through a connection bar 85. More particularly, the connection bar 85 is connected at one end thereof to a substantially middle portion of the operating lever 82 by a support pin 83, and connected at the other end thereof to the movable ring 8 by a support pin 84.

Again referring to FIG. 7, the light bulb changing tool according to the embodiment of the present invention further includes a light bulb-receiving structure. The light bulb-receiving structure includes a tubular strut 11 and a seat pad 10 provided on an upper end of the tubular strut 11 for receiving and supporting a top surface of the glass sphere of the light bulb. The seat pad 10 has a circular shape when viewed in the plane view (see FIG. 5). An upper surface of the seat pad 10 is formed in a tapered concave shape that allows the seat pad 10 to receive and support the top surface of the glass sphere. The tubular strut 11 is received in the arm holder 1 and extends from an upper end of the arm holder 1 toward the upper end portions of the chuck arms 2*a*, 2*b*, 2*c*. The seat pad 10 is surrounded by the upper end portions of the chuck arms 2*a*, 2*b*, 2*c*.

A cap 11*a* is fixedly fitted in the upper end of the arm holder 1. The tubular strut 11 is passed through the cap 11*a* and is slidably held by the cap 11*a*. In addition, the tubular strut 11 is elastically supported by a second extension spring 11*b*. The tubular strut 11 has a spring-receiving block 11*c* fixedly arranged therein. Moreover, the arm holder 1 also has a spring-receiving block 11*d* fixedly arranged therein. The second extension spring 11*b* is provided between the spring-receiving blocks 11*c*, 11*d* and supported by these spring-receiving blocks 11*c*, 11*d*.

The top dead point of the seat pad 10 is set to a high place where the seat pad 10 can receive and support a top surface of a small glass sphere which a light bulb has and where the tips of the chuck arms 2*a*, 2*b*, 2*c* can chuck a region of the glass sphere which is adjacent a cap of the light bulb.

Figure 9:
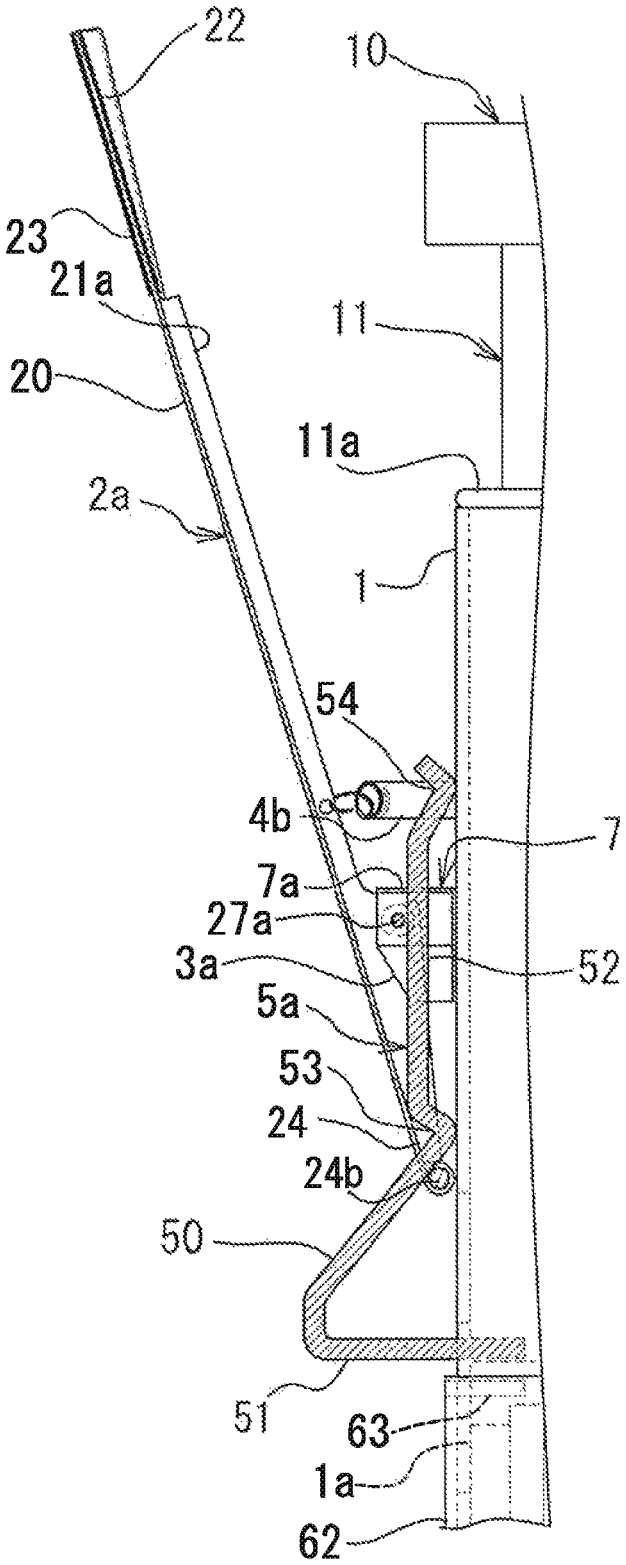
FIG. 9 is a schematic explanatory view illustrating an opened state of the chuck arm shown in FIGS. 3*a* and 3*b;*

In the light bulb changing tool constructed as discussed above, the guide bars 5*a*, 5*b*, 5*c* are slidably combined with the chuck arms 2*a*, 2*b*, 2*c*, with the second axial portions 51 thereof being projected outward from the chuck arms 2*a*, 2*b*, 2*c* through the slits 24 of the chuck arms 2*a*, 2*b*, 2*c*, with the remaining axial portions thereof being arranged inside the chuck arms, and with the first axial portions 50 thereof being engaged with the lower edges of the slits 24 of the chuck arms 2*a*, 2*b*, and 2*c*. When the operator operates the operating lever 82 to thereby move the movable ring 8 downward as shown in FIG. 8*b*, the traction wire 8*a* is pulled downward and the bar holder block 6 is moved downward against the action of the first extension spring 60. At this time, the guide bars 5*a*, 5*b*, 5*c* are slid downward relative to the chuck arms 2*a*, 2*b*, 2*c* while being engaged at the first axial portions 50 thereof with the lower edges of the slits 24 of the chuck arms 2*a*, 2*b*, 2*c*. Namely, the first axial portions 50 of the guide bars 5*a*, 5*b*, 5*c* are pulled out of the chuck arms via the slits 24 of the chuck arms as shown in FIG. 9. By the movement of the guide bars 5*a*, 5*b*, 5*c* relative to the chuck arms 2*a*, 2*b*, 2*c*, the lower ends of the third axial portions 52 of the guide bars 5*a*, 5*b*, 5*c* are operatively abutted against the lower end portions of the chuck arms 2*a*, 2*b*, 2*c*, whereby the chuck arms 2*a*, 2*b*, 2*c* are pivoted against the actions of the tension springs 4*a*, 4*b*, 4*c* in such a manner that the lower end portions of the chuck arms 2*a*, 2*b*, 2*c* approach the arm holder 1 and the upper end portions of the chuck arms 2*a*, 2*b*, 2*c* are moved away from one another. Thus, the upper end portions of the chuck arms 2, 2*b*, 2*c* are maintained in an opened state.

In this condition, when a light bulb that has been attached to the socket installed at the high place, such as the ceiling of the house or building, is to be removed from the socket by the light bulb changing tool, the handle rod P is lifted up to the high place by the operator and the glass sphere of the light bulb can be positively received in a space among the opened upper end portions of the chuck arms 2*a*, 2*b*, 2*c* and supported on the seat pad 10. After the glass sphere of the light bulb is received in the space among the opened upper end portions of the chuck arms 2*a*, 2*b*, 2*c* and supported on the seat pad 10, the operation lever 82 is released from the operation by the operator. At this time, the bar holder block 6 is moved upward within the arm holder 1 by the action of the first extension spring 60, and the guide bars 5*a*, 5*b*, 5*c* are synchronously moved upward until the lower ends of the first axial portions 50 of the guide bars 5*a*, 5*b*, 5*c* are operatively abutted against the lower edges of the slits 24 formed in the chuck arms 2*a*, 2*b*, 2*c*, whereby the upper end portions of the chuck arms 2*a*, 2*b*, 2*c* are operatively closed relative to one another due to the actions of the tension springs 4*a*, 4*b*, 4*c* and chuck the glass sphere of the light bulb with the tips thereof pinching a region of the glass sphere which is adjacent a cap of the light bulb. Thus, the glass sphere of the light bulb can be positively chucked by the chuck arms 2*a*, 2*b*, 2*c*. In this condition, the light bulb can be removed from the socket by rotating the handle rod P by the operator in such a manner to unscrew the cap of the light bulb. Then, the operator again operates the operating lever 82 in such a manner that the upper end portions of the chuck arms 2*a*, 2*b*, 2*c* are operatively opened away from one another as discussed above, and can manually remove the light bulb from the chuck arms 2*a*, 2*b*, 2*c*.

After the light bulb is removed from the chuck arms 2*a*, 2*b*, 2*c*, the operator places a new light bulb into the space among the opened upper end portions of the chuck arms 2*a*, 2*b*, 2*c* in such a manner that a top surface of a glass sphere of the new light bulb is carried on the seat pad 10. In this condition, when the operator releases the operation of the operating lever, the upper end portions of the chuck arms 2*a*, 2*b*, 2*c* are operatively closed relative to one another, to thereby chuck the new light bulb. Thus, the operator can attach the new light bulb to the socket in lieu of the removed light bulb by lifting the handle rod P up to the high place and rotating it so as to screw the cap of the new light bulb into the socket.

As discussed above, it is possible to reliably hold the glass sphere of the light bulb at the high place with the chuck means C, easily remove the light bulb from the socket at the high place by rotating the handle rod P to unscrew the cap of the light bulb, and easily attach the new light bulb to the socket in lieu of the removed light bulb by rotating the handle P to screw the new light bulb into the socket.

Figure 10:
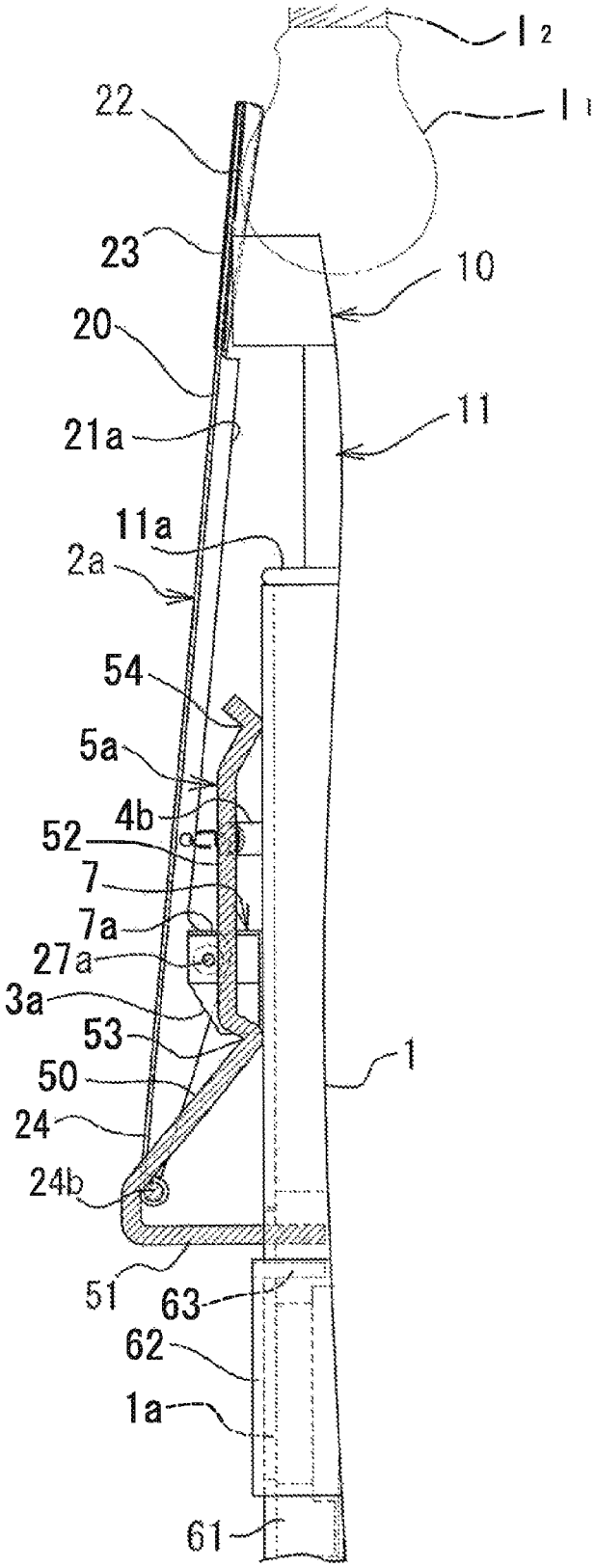
FIG. 10 is a schematic explanatory view illustrating a small-sized light bulb held or chucked by the chuck means shown in FIG. 2.

When a glass sphere of a small-sized light bulb attached to the socket is to be held or chucked by the chuck arms 2*a*, 2*b*, 2*c* as shown in FIG. 10, the glass sphere $I_1$ of the small-sized light bulb is received in the space among the opened upper end portions of the chuck arms 2*a*, 2*b*, 2*c* in such a manner that a top surface of the glass sphere $I_1$ is carried on the seat pad 10. In this condition, when the operation of the operating lever 82 by the operator is released, the upper end portions of the chuck arms are operatively closed relative to one another due to the actions of the tension springs 4*a*, 4*b*, 4*c*, whereby a portion of the glass sphere which extends from the top surface of the glass sphere to a region of the glass sphere that is adjacent a cap $I_2$ of the light bulb can be positively held or chucked by the upper end portions of the chuck arms 2*a*, 2*b*, 2*c*.

Figure 11:
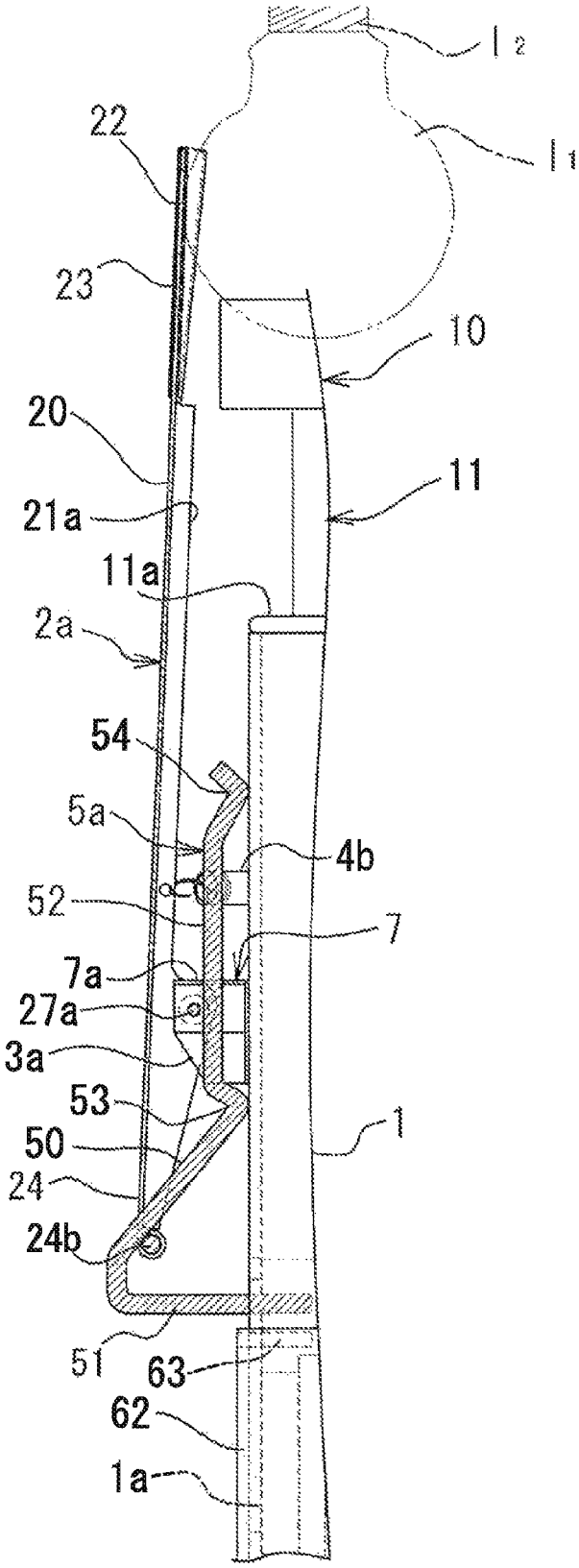
FIG. 11 is a schematic explanatory view illustrating a medium-sized light bulb held or chucked by the chuck means shown in FIG. 2.
Figure 12:
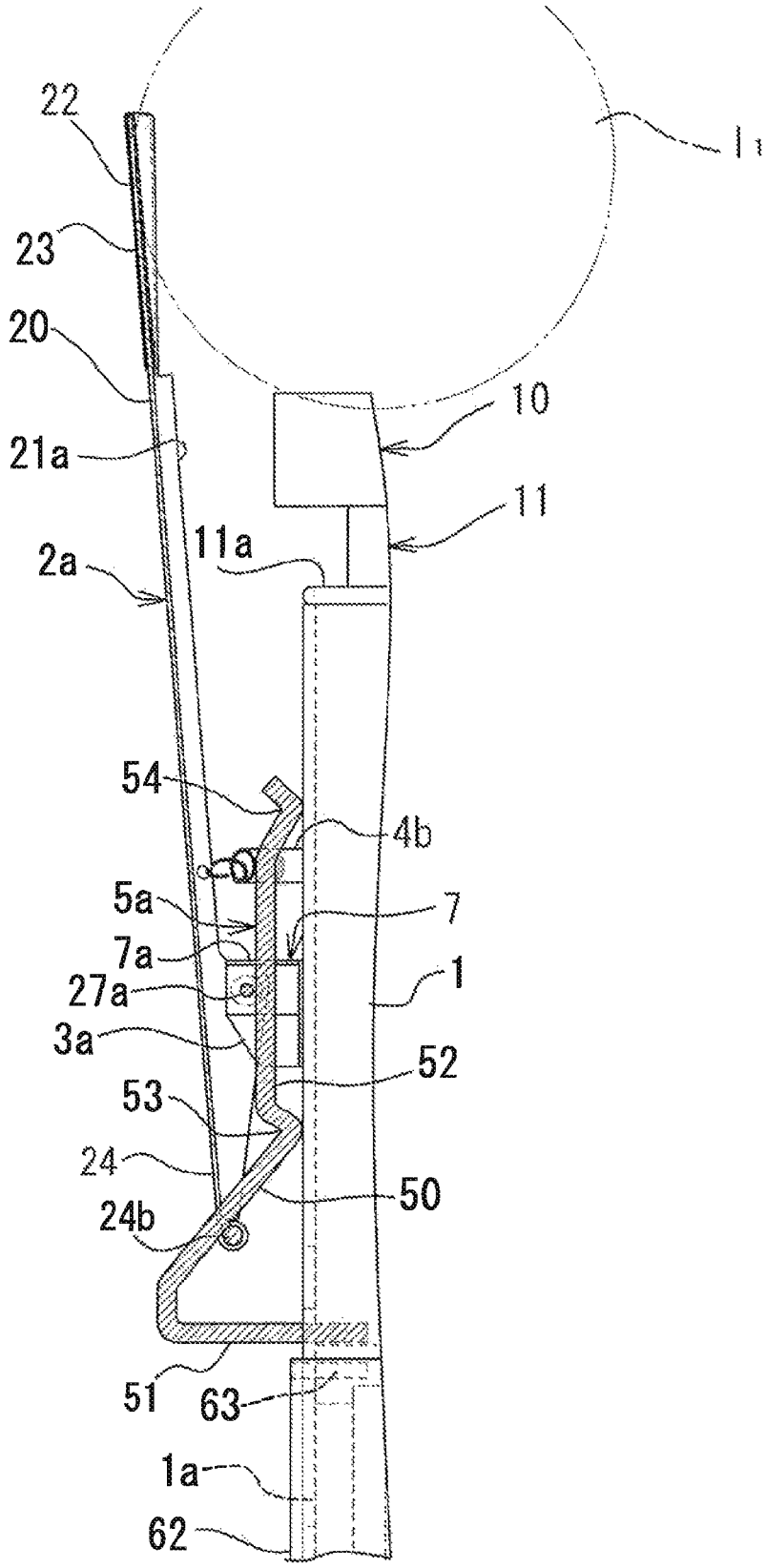
FIG. 12 is a schematic explanatory view illustrating a large-sized light bulb held or chucked by the chuck means shown in FIG. 2.

When a glass sphere of a medium-sized light bulb or a glass sphere of a large-sized light bulb which has been attached to the socket is to be held or chucked by the chuck arms 2*a*, 2*b*, 2*c*, as shown in FIG. 11 or 12, a glass sphere $I_1$ of the light bulb is received in the space among the opened upper end portions of the chuck arms 2*a*, 2*b*, and 2*c*. In this condition, when the seat pad 10 is pressed against a top surface of the glass sphere $I_1$ of the light bulb by pushing the handle rod P up, the tubular strut 11 is moved into the arm holder 1 against the action of the second extension spring 11*b*, and the top surface of the glass sphere $I_1$ is elastically supported on the seat pad 10. Then, when the operation of the operating lever 82 by the operator is released, the upper end portions of the chuck arms are operatively closed relative to one another due to the actions of the tension springs 4*a*, 4*b*, 4*c*, whereby a portion of the glass sphere which extends from the top surface of the glass sphere to a region of the glass sphere that is adjacent a cap $I_2$ of the light bulb can be positively held or chucked by the upper end portions of the chuck arms 2*a*, 2*b*, 2*c*.

Thus, the tool according to the embodiment of the present invention can easily remove and replace any light bulbs having glass spheres of different sizes, such as a small-sized light bulb, a medium-sized light bulb, and a large-sized light bulb.

Incidentally, the third axial portions 52 of the guide bars 5*a*, 5*b*, 5*c* are inserted through the through-holes 7*a* of the substantially U-shaped pieces 7 (fixedly combined with the bearing bracket bodies) so as to be linearly movable, so that the upper end portions of the chuck arms 2*a*, 2*b*, 2*c* can be stably opened away from one another and stably closed relative to one another by the movement of the guide bars 5*a*, 5*b*, 5*c*.

While the above description has been made of the light bulb changing tool which can remove and replace any light bulbs having glass spheres of various sizes, the present invention may be applied to a light bulb changing tool for a large-sized light bulb only, or a light bulb changing tool for a medium-sized light bulb only, or a light bulb changing tool for a small-sized light bulb, in which the dimensions of the chuck arms are varied according to the sizes of the glass spheres. For example, the length of the chuck arms for holding or chucking a glass sphere of a large-sized light bulb may be increased.

The terms and expressions which have been employed herein are used as terms of description and not of limitation, and there is no intention in the use of such terms and expressions of excluding any equivalents of the features shown and described, or portions thereof, but it is recognized that various modifications are possible within the scope of the invention claimed.

What is claimed is:

1. A tool for removing and replacing a light bulb, comprising:

a long handle rod adapted to be held and lifted up to a high place by the hand of an operator;

a chuck provided at an upper end portion of the handle rod for chucking or holding a glass sphere of the light bulb; and an operating mechanism provided at a lower end portion of the handle rod for actuating the chuck, the chuck comprising:

an arm holder of a substantially cylindrical shape fixed to the upper end portion of the handle rod;

the arm holder having a movable bar-holder-block and a first extension spring for urging the movable bar-holder-block upward;

the movable bar-holder-block and the first extension spring being housed within the arm holder;

the arm holder being formed with at least three vertically extending holes which are spaced apart from one another at regular intervals around a periphery of the arm holder;

at least three bearing brackets attached to the arm holder so as to be spaced apart from one another at regular intervals around an outer periphery of the arm holder;

at least three chuck arms for chucking or holding the glass sphere of the light bulb;

the chuck arms being pivotally supported at lower end portions thereof on the bearing brackets with upper end portions thereof extending to a position higher than the arm holder;

each of the chuck arms having a length that allows a tip of the upper end portion of the chuck arm to hold a region of the glass sphere which is adjacent a cap of the light bulb;

second tension springs for urging the chuck arms in such a direction that causes the upper end portions of the chuck arms to be closed relative to one another;

each of the second tension springs being stretched between adjacent chuck arms;

a seat pad attached to an upper end of the arm holder for receiving and supporting a top surface of the glass sphere held or chucked by the chuck arms; and at least three guide bars for causing the chuck arms to be pivoted in such a manner that the upper end portions of the chuck arms are operatively opened away from one another against actions of the second tension springs;

each of the guide bars being slidably combined with corresponding one of the chuck arms and supported through corresponding one of the vertically extending holes of the arm holder by the movable bar-holder-block; and the movable bar-holder-block being connected to the operating mechanism via a traction wire, so that when the operating mechanism is operated by the operator, the movable bar-holder-block is moved downward within the arm holder against an action of the first extension spring while allowing the guide bars to be moved downward relative to the chuck arms, to thereby cause the chuck arms to be pivoted against actions of the second tension springs in such a manner that the upper end portions of the chuck arms are operatively opened away from one another.

2. The tool as defined in claim 1, wherein the light bulb comprises a large-sized light bulb having a large-sized glass sphere, or a medium-sized light bulb having a medium-sized glass sphere, or a small-sized light bulb having a small-sized glass sphere, a length of each of the chuck arms is increased in order that the tip of the upper end portion of the chuck arm can hold a region of the large-sized glass sphere which is adjacent a cap of the large-sized light bulb, and the seat pad is attached to the upper end of the arm holder through a tubular strut which is received in the arm holder and supported so as to be urged upward by a third extension spring that is provided between the tubular strut and the arm holder, so that the seat pad can elastically and stably support a top surface of the large-sized sphere thereon due to an action of the third extension spring.

3. The tool as defined in claim 2, wherein each of the guide bars includes a first axial portion obliquely extending vertically, a second axial portion extending laterally from a lower end of the first axial portion, and a third linear axial portion extending upward from an upper end of the first axial portion, and wherein each of the chuck arms has a vertically extending slit formed in the lower end portion thereof, each guide bar being slidably combined with the chuck arm with the second axial portion thereof projecting out of the chuck arm through the vertically extending slit and with the remaining axial portions being arranged inside the chuck arm and supported by corresponding one of the bearing brackets, and a tip end portion of the second axial portion being fixed to the movable bar-holder-block through the corresponding one of the vertically extending holes of the arm holder.

4. The tool as defined in claim 1, wherein each of the guide bars includes a first axial portion obliquely extending vertically, a second axial portion extending laterally from a lower end of the first axial portion, and a third linear axial portion extending upward from an upper end of the first axial portion, and wherein each of the chuck arms has a vertically extending slit formed in the lower end portion thereof, each guide bar being slidably combined with the chuck arm with the second axial portion thereof projecting out of the chuck arm through the vertically extending slit and with the remaining axial portions being arranged inside the chuck arm and supported by corresponding one of the bearing brackets, and a tip end portion of the second axial portion being fixed to the movable bar-holder-block through the corresponding one of the vertically extending holes of the arm holder.

* * * * *